US012049819B2

(12) United States Patent
Hernandez Marti et al.

(10) Patent No.: US 12,049,819 B2
(45) Date of Patent: Jul. 30, 2024

(54) DIRECT DRIVE FOR A RESERVOIR FLUID PUMP

(71) Applicant: Halliburton Energy Services, Inc., Houston, TX (US)

(72) Inventors: Ramon Hernandez Marti, Houston, TX (US); Sudhir Kumar Gupta, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 273 days.

(21) Appl. No.: 17/612,304

(22) PCT Filed: Jul. 8, 2019

(86) PCT No.: PCT/US2019/040813

§ 371 (c)(1),
(2) Date: Nov. 18, 2021

(87) PCT Pub. No.: WO2021/006865

PCT Pub. Date: Jan. 14, 2021

(65) Prior Publication Data

US 2022/0228485 A1 Jul. 21, 2022

(51) Int. Cl.
*E21B 49/08* (2006.01)
*E21B 47/06* (2012.01)
(Continued)

(52) U.S. Cl.
CPC ..... *E21B 49/082* (2013.01); *E21B 47/06* (2013.01); *F04B 9/02* (2013.01); *F04B 17/03* (2013.01); *F04B 53/14* (2013.01)

(58) Field of Classification Search
CPC ..... E21B 49/082; E21B 47/06; F04B 9/02; F04B 17/03; F04B 53/14
See application file for complete search history.

(56) References Cited

U.S. PATENT DOCUMENTS

2008/0245569 A1 10/2008 Nold et al.
2009/0321072 A1 12/2009 Kanayama et al.
(Continued)

FOREIGN PATENT DOCUMENTS

EP 3023638 A1 5/2016
WO WO-2013148005 A1 * 10/2013 ..... E21B 21/10
WO 2021006865 A1 1/2021

*Primary Examiner* — Dany E Akakpo
(74) *Attorney, Agent, or Firm* — John Wustenberg; Parker Justiss, P.C.

(57) ABSTRACT

The disclosure provides a formation fluid pumping method and pump, and a wellbore system that in one example includes wellbore surface equipment connected to a downhole tool including a formation fluid container having a fluid input port and a fluid output port, and a moveable piston inside the formation fluid container having two fluid chambers positioned to alternately pump a quantity of formation fluid in the formation fluid container from the fluid input port to the fluid output port. The wellbore system further includes a mechanical piston actuator having a rotary portion attached to the formation fluid container and a linear portion attached to the moveable piston, and a brushless direct current motor coupled to the rotary portion of the mechanical piston actuator and controlled to alternately rotate the rotary portion of the mechanical piston actuator in opposite directions to pump the quantity of formation fluid.

20 Claims, 6 Drawing Sheets

(51) Int. Cl.

| | |
|---|---|
| ***F04B 9/02*** | (2006.01) |
| ***F04B 17/03*** | (2006.01) |
| ***F04B 53/14*** | (2006.01) |

(56) References Cited

U.S. PATENT DOCUMENTS

| | | | |
|---|---|---|---|
| 2013/0255367 | A1 | 10/2013 | Dussan et al. |
| 2015/0000393 | A1 | 1/2015 | Hernandez Marti et al. |
| 2017/0016290 | A1* | 1/2017 | Manwill ..... E21B 34/10 |

* cited by examiner

DIRECT DRIVE FOR A RESERVOIR FLUID PUMP

CROSS-REFERENCE TO RELATED APPLICATION

This application is the National Stage of, and therefore claims the benefit of, International Application No. PCT/US2019/040813 filed on Jul. 8, 2019, entitled "DIRECT DRIVE FOR A RESERVOIR FLUID PUMP", which was published in English under International Publication Number WO 2021/006865 on Jan. 14, 2021. The above application is commonly assigned with this National Stage application and is incorporated herein by reference in its entirety.

TECHNICAL FIELD

This application is directed, in general, to monitoring of hydrocarbon wellbores and, more specifically, to an improved system and method for collecting formation fluid samples.

BACKGROUND

Many current hydrocarbon reservoir sampling tools use induction motors for downhole sampling. Unless a variable frequency control system is employed (e.g., as with production pumps), controlling motor speed or direction of rotation is either difficult or inefficient. Current solutions use a hydraulic pump and hydraulic power to control downhole tool mechanical functions, (e.g., the sample pumping of reservoir fluids). All required regulation is done hydraulically, and the electric motors used require that they continuously dissipate near maximum power. The above arrangements accumulate the inefficiencies of different energy conversions, resulting in overheating and their cohort of reliability concerns. Also, the operation of hydraulic valves to control pumping operations introduces additional reliability issues.

BRIEF DESCRIPTION

Reference is now made to the following descriptions taken in conjunction with the accompanying drawings, in which.

DETAILED DESCRIPTION

When performing subterranean operations, wellbore fluid sampling may be used to determine many important characteristics of the downhole environment. For example, when performing subterranean operations, it may be desirable to monitor or sample certain properties of fluids used in conjunction with production of subterranean operations, such as pressure, temperature, density, viscosity, and other quantities such as the contents of oil including water or gas. Sampling of formation fluids requires that the fluid sample remains as true as possible to its in-situ formation condition to accurately reflect formation fluid conditions. This requirement dictates several constraints on formation fluid sampling devices that are challenging to meet with current equipment. Solutions for better managing these constraints are presented in examples of this disclosure.

One such solution includes a formation fluid pump that employs a brushless direct current motor and a mechanical piston actuator to linearly move a piston inside a formation fluid container to extract a quantity of formation fluid. The disclosed formation fluid pump provides several advantages compared to conventional formation fluid sampling devices. For example, direct drive of the formation fluid pump provides better efficiency and control than with the existing hydraulic drive thereby eliminating the need for a hydraulic circuit for formation fluid pumping. A more efficient and improved operational control and a more reliable operation is provided by suppressing the hydraulic circuit and reducing operating temperatures. More power is available for pumping rather than being wasted in heat. A smaller overall footprint is available with a resulting reduction in downhole tool length, weight and complexity. A more precise pump piston motion control is obtained, and a reduced overall maintenance is also obtained since a drive motor and a gearbox can reside at atmospheric pressure rather than in pressure compensated hydraulic oil. Reduced cost can also be achieved since the hydraulic drive components are eliminated.

Figure 1A:
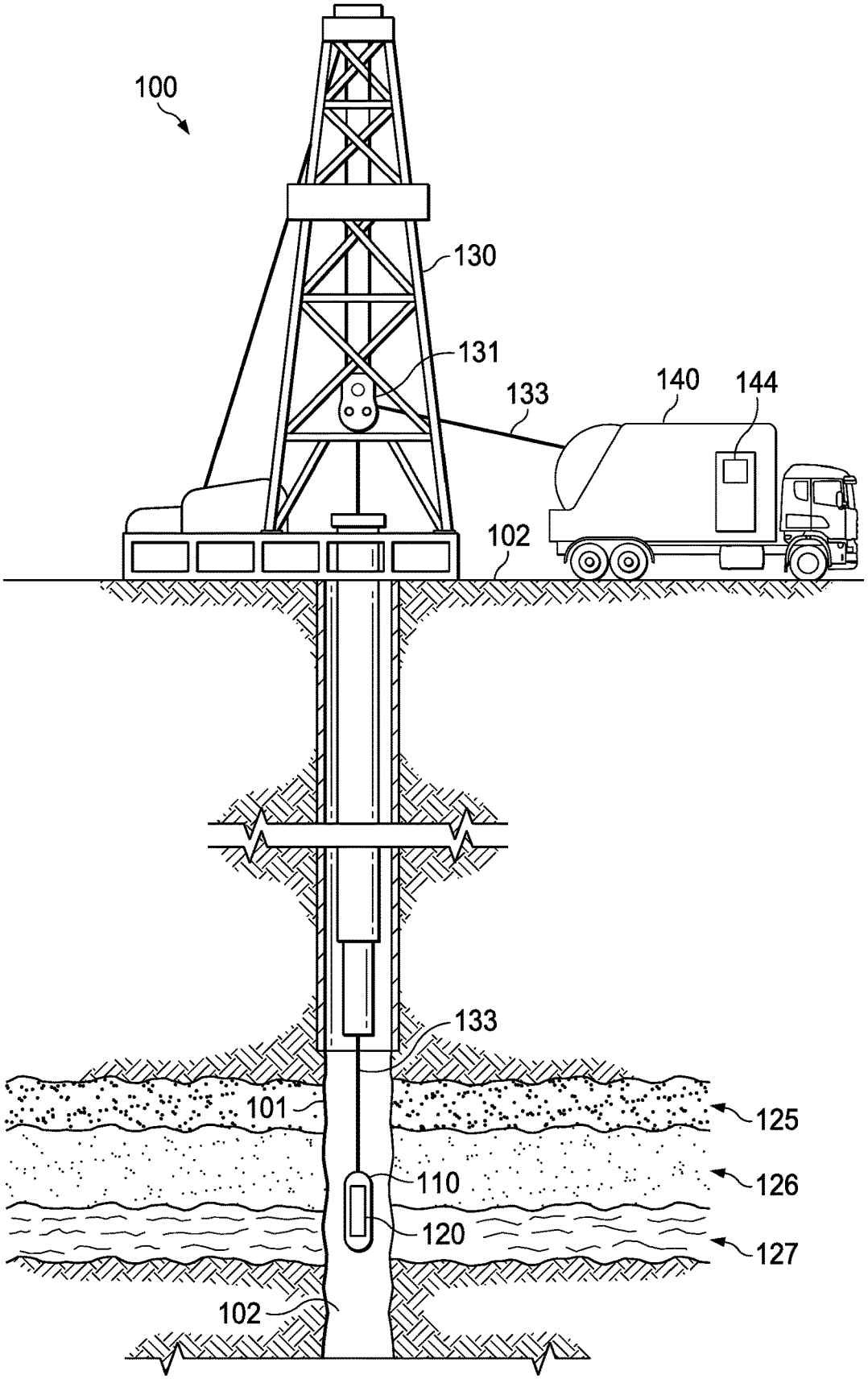
FIG. 1A illustrates an example of a wellbore system that performs sampling for testing on subterranean formations.

Now turning to the figures, FIG. 1A illustrates an example of a wireline wellbore system, generally designated 100, that performs sampling for testing on subterranean formations. During drilling or after final drilling of a wellbore 101 from a surface location 102 is complete, it is usually desirable to know additional details about types of formation fluids and their associated characteristics through sample collection employing formation logging or fluid sampling. The wellbore system 100 includes a downhole tool, measurement tool 110 having a depth correlation unit that forms part of a logging operation that can be used for accurate depth control. The depth correlation unit in the downhole measurement tool 110 provides current depth data from the wellbore 101 through a conveyance 133 for recording of current depth data in a logging unit 140 (i.e., a surface logging facility). The depth correlation unit can be, for example, a gamma ray logging sensor unit or a casing collar locator. Furthermore, a load sensor attached to the conveyance 133 and the downhole measurement tool 110 may be present to further aid in determination of the depth profile along conveyance 133.

The wellbore system 100 also includes a derrick 130 that supports a traveling block 131 and the downhole measurement tool 110 in the form of a sonde or probe that is lowered by the conveyance 133 into the wellbore 101. The conveyance 133 may be a wireline, slickline, coiled tubing, drill pipe, or other cable or conveyance suitable for a logging operation. Generally, any conveyance that allows for the operation of a downhole logging tool and provides depth control can be employed. In one example, the downhole measurement tool 110 may be lowered to a region of interest in the wellbore 101 and pulled upward at a substantially constant speed to gain logging information for wellbore structures such as subterranean formations 125, 126 and 127. Additionally, the downhole measurement tool 110 may be held stationary within the wellbore 101 to gather wellbore or fluid formation samples at one or more of the subterranean formations 125, 126 and 127.

In the illustrated example of FIG. 1A, the downhole measurement tool 110 also includes a direct drive formation fluid pump 120 that is generally configured to gather formation fluid samples and then convey these samples to the surface 102 by retrieval of the conveyance 133 to the logging unit 140 for storage, processing or analysis. The logging unit 140 is provided with necessary equipment 144 to accomplish this storage, processing or analysis.

Figure 1B:
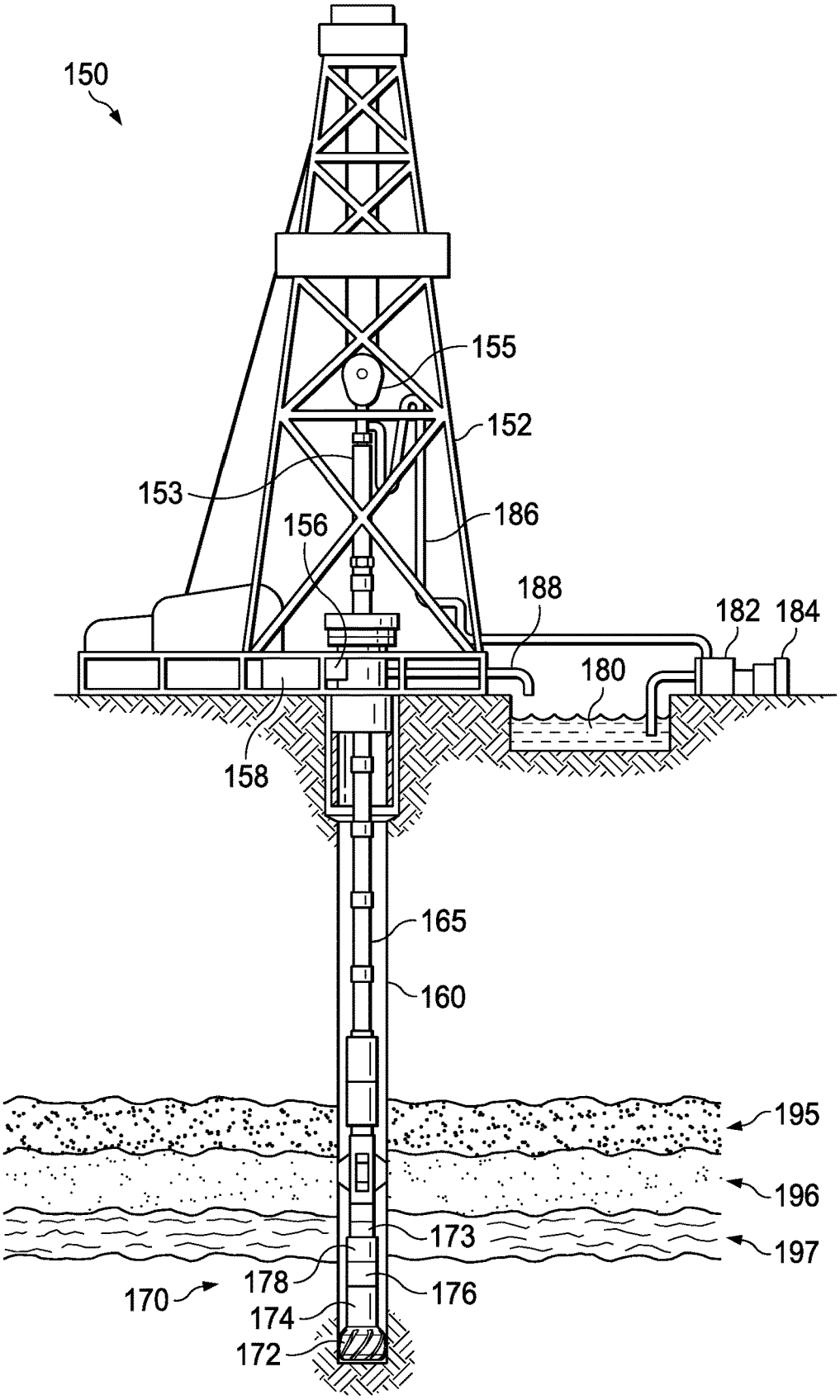
FIG. 1B illustrates another example of a wellbore system that performs sampling for testing on subterranean formations.

FIG. 1B illustrates an example of a wellbore system, generally designated 150, that performs formation drilling. The wellbore system 150 can incorporate logging operations of a borehole 160 and surrounding subterranean formations while drilling. Wellbore system 150 is configured to drive a bottom hole assembly (BHA) 170 positioned or otherwise arranged at the bottom of a drill string 165 extended into the earth from derrick 152 arranged at the surface. Derrick 152 includes a kelly 153 and a traveling block 155 used to lower and raise the kelly 153 and drill string 165.

BHA 170 includes a drill bit 172 operatively coupled to a tool string 173 which may be moved axially within the wellbore 160 as attached to the tool string 173. During operation, drill bit 172 penetrates the earth and thereby creates wellbore 160. BHA 170 provides directional control of drill bit 172 as it advances into the earth.

Fluid or "drilling mud" from a mud tank 180 may be pumped downhole using a mud pump 182 powered by an adjacent power source, such as a prime mover or motor 184. The drilling mud may be pumped from mud tank 180, through a stand pipe 186, which feeds the drilling mud into drill string 165 and conveys the same to drill bit 172. The drilling mud exits one or more nozzles arranged in drill bit 172 and in the process cools drill bit 172. After exiting drill bit 172, the mud circulates back to the surface via the annulus defined between the wellbore 160 and the drill string 165, and in the process, returns drill cuttings and debris to the surface. The cuttings and mud mixture are passed through a flow line 188 and are processed such that a cleaned mud is returned down hole through the stand pipe 186 once again.

Tool string 173 can be semi-permanently mounted with various measurement tools (not shown) such as, but not limited to, measurement-while-drilling (MWD) and logging-while-drilling (LWD) tools, that may be configured to take downhole measurements of drilling conditions. For example, the tool string 173 can include a downhole tool 174 that collects logging data as the drill bit 172 extends the borehole 160 through subterranean formations 195, 196, 197.

Additionally, the wellbore system 150 can employ a direct drive formation fluid pump 176 to gather formation fluid samples during a drilling operation. In these cases, the direct drive formation fluid pump 176 can be included in the tool string 173 and powered by a downhole power source. Formation fluid sample capture may be orchestrated by electrical, hydraulic, acoustic or electromagnetic initiation signals, at periodic or preprogrammed time intervals or triggered by a downhole event. A status of formation fluid sample capturing may be included in current up-hole communications of logging or drilling parameters. The captured formation fluid samples can be retrieved during bit replacement tripping or during additional tripping operations based on drilling operations protocol.

For purposes of communication, a downhole telemetry transceiver 178 can be included in the BHA 170, either separately or as part of the tool string 173 or the downhole tool 174. Downhole telemetry transceiver 178 can transfer measurement data to a surface transceiver 156 and receive commands from the surface, such as for the direct drive formation fluid pump 176. Mud pulse telemetry is one common telemetry technique for transferring tool measurements to surface receivers and receiving commands from the surface. Other telemetry techniques typically used in LWD or MWD systems can also be used. In some embodiments, downhole telemetry transceiver 178 can store logging data for later retrieval at the surface when the logging assembly is recovered.

At the surface, surface transceiver 156 can receive the uplink signal from the downhole telemetry transceiver 178 and can communicate the signal to well controller equipment 158. Well controller equipment 158 can include one or more processors, storage mediums, input devices, output devices, software, and other computing components and systems. Well controller equipment 158 can collect, store, and/or process the data received from downhole tool 174 as described herein. For example, the well controller equipment 158 can process wellbore sampling data such as disclosed herein.

In one example, operating control signals for the direct drive formation fluid pump 176 may be provided up-hole and conveyed to the direct drive formation fluid pump 176 downhole via the telemetry transceiver 178. Operating power may be provided by a downhole power generator or battery within the tool string 173, and control signals may be preprogrammed to orchestrate sample gathering downhole based on elapsed time or wellbore depth information.

Figure 2:
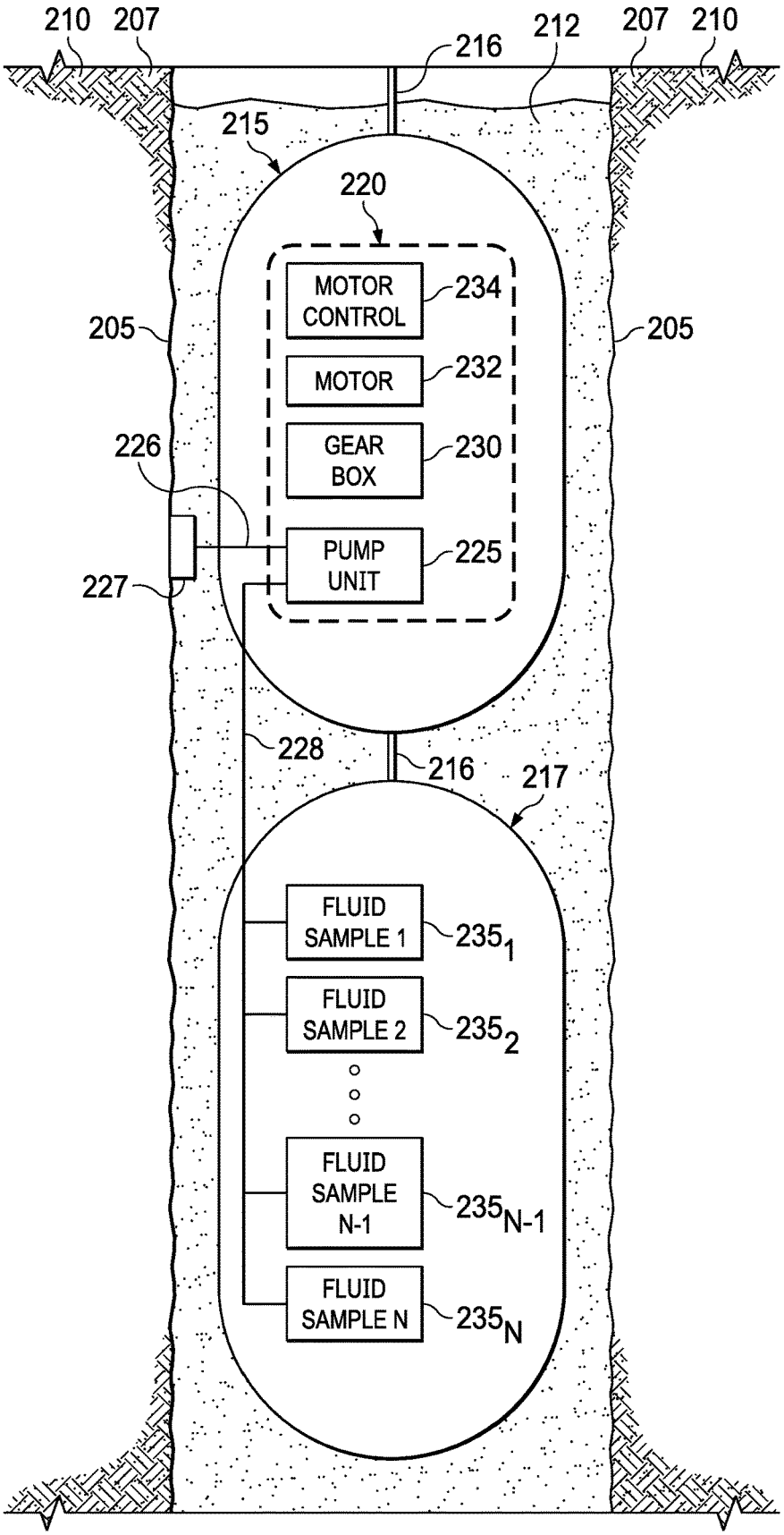
FIG. 2 illustrates a block diagram example of a downhole measurement environment constructed according to the principles of the present disclosure.

FIG. 2 illustrates a block diagram example of a downhole measurement environment, generally designated 200, constructed according to the principles of the present disclosure. The downhole measurement environment 200 includes a wellbore 205 containing a wellbore fluid 212, a subterranean formation 207 containing a formation fluid 210, a downhole measurement tool 215, a logging cable 216, a fluid pump 220 employing direct drive pumping and a collection of formation fluid sample containers $\mathbf{235}_1$-$\mathbf{235}_N$ contained in a formation sample tool 217. The subterranean formation 207 provides the formation fluid 210 to be sampled and the logging cable 216 connects the downhole measurement tool 215 electrically to surface equipment (not shown). The subterranean formation 207 is generally isolated from the well by drilling mud located on the wellbore 205. A wellbore pad 227 presses against the wellbore 205 to isolate the formation fluid 210 from the wellbore fluid 212 for a formation fluid input port 226. The fluid pump 220 includes a pump unit 225 employing the formation fluid input port 226 and a formation fluid output port 228 connected to the fluid sample containers $\mathbf{235}_1$-$\mathbf{235}_N$.

The formation fluid input port 226 supplies formation fluids to the pump unit 225, which in turn pumps one or more samples of each formation fluid of interest through the formation fluid output port 228 into the formation fluid sample containers $\mathbf{235}_1$-$\mathbf{235}_N$ for storage. In this example, analysis of each formation sample is performed after the downhole measurement tool 215 is returned to the surface. In another example, analysis of one or more formation samples may be performed while the downhole measurement tool 215 and the formation sample tool 217 is still downhole by employing the logging cable 216 for analysis control from the surface or by use of analysis preprogramming downhole. Then, downhole analysis results may be transmitted to the surface employing the logging cable 216.

In addition to the pump unit 225, the fluid pump 220 includes a gear box 230, an electric motor 232 and an electric motor controller 234. The gear box 230 employs a gear ratio that provides an output shaft speed required by the fluid pump 220 to pump more effectively or efficiently, while allowing an output torque of the electric motor 232 to be controlled or maximized by the electric motor controller 234. The gear box 230 may typically provide a rotary speed reduction to the pump unit 225. In the illustrated example of FIG. 2, the pump unit 225 is pressure compensated at wellbore pressures while the gear box 230, the electric motor 232 and the electric motor controller 234 may reside at atmospheric pressure.

Figure 3:
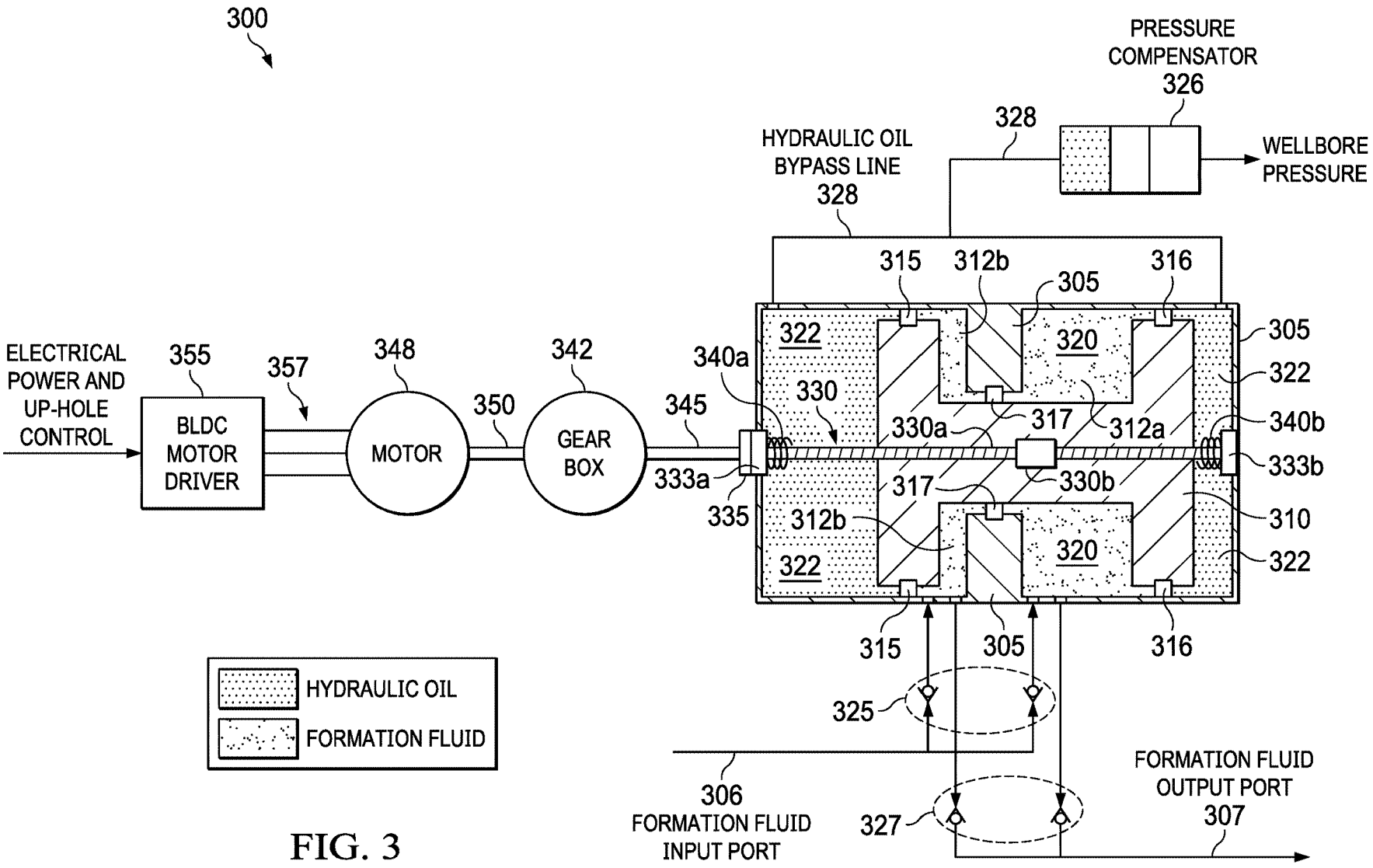
FIG. 3 illustrates an example of a formation fluid pump constructed according to principles of the present disclosure.

FIG. 3 illustrates an example of a fluid pump, generally designated 300, constructed according to principles of the present disclosure. The fluid pump 300 is a variable speed, mechanical direct-drive pump employing a pressure-balanced push-pull piston. In the illustrated example of FIG. 3, the pump piston is surrounded by hydraulic oil, which is only employed to provide pressure compensation and some lubrication of sliding piston seals. There is minimal contamination of the hydraulic oil from fluid leaking through the sliding seals due to the innate pressure balancing thereby generally reducing or avoiding major filtering, contaminated valves or extensive maintenance. Since the piston is pressure balanced, the only force a drive motor needs to supply is to overcome seal friction and fluid drag forces in associated fluid conduits. Additionally, only the pump enclosure or container employs the hydraulic oil, and mechanical drive components (e.g., the motor and a gear box) operate outside of the hydraulic oil thereby simplifying downhole tool construction and maintenance. A resulting smaller pressurized volume may allow reducing the size of the compensating piston thereby allowing for reduced downhole tool dimensions.

The fluid pump 300 includes a fluid container 305, a formation fluid input port 306, a formation fluid output port 307, a moveable piston 310 having two fluid chambers 312*a*, 312*b*, first, second and third seals 315, 316, 317, container of formation fluid 320, container of hydraulic oil 322, a pair of input check valves 325 and a pair of output check valves 327. The fluid pump 300 also includes a mechanical piston actuator 330 having a rotary portion 330*a* and a linear portion 330*b*, first and second actuator bearing seals 333*a*, 333*b* and an alternative magnetic coupling device 335. The fluid pump 300 further includes a wellbore pressure compensator 326 coupled to a hydraulic oil bypass line 328, first and second torsion relief springs 340*a*, 340*b*, a gear box 342 having a gear box output shaft 345, a brushless direct current (BLDC) electric motor 348 having a motor output shaft 350, and a BLDC motor driver 355 connected to the BLDC electric motor 348 via motor power and control lines 357. The BLDC motor driver 355 receives electrical power and control signals to operate the BLDC electric motor 348. The control signals can be received from the surface via an up-hole control input. The electrical power can also be received from the surface or can be provided from a downhole power source. A conveyance can provide the electrical power and up-hole control input. The conveyance can be, for different examples, the conveyance 133 or the drill string 165 noted above. Here, wellbore pressure is close to or slightly larger than formation pressure to keep the formation fluids in place but not to contaminate the formation with wellbore fluid.

The fluid container 305 and the moveable piston 310 are cylinders in this example, and the first, second and third seals 315, 316, 317 provide sliding seals between the fluid container 305 cylinder and the moveable piston 310 cylinder. The two fluid chambers 312*a*, 312*b* have comparable fluid capacities formed by the fluid container 305 and the moveable piston 310 and typically contain different quantities of formation fluid 320 as the moveable piston 310 traverses the fluid container 305. In the example of FIG. 3, the fluid chamber 312*a* is at maximum fluid capacity and the fluid chamber 312*b* is at minimum fluid capacity, where the moveable piston 310 is about to reverse direction. The fluid chamber 312*a* has been filling by pulling formation fluid 320 through the fluid input port 306 while the fluid chamber 312*b* has been emptying by pushing formation fluid 320 through the formation fluid output port 307 for sample storage. This action provides a push-pull pumping action that allows the moveable piston 310 to pressure compensate itself.

As the moveable piston 310 reverses direction, the fluid chamber 312*b* starts pulling formation fluid 320 through the fluid input port 306 while the fluid chamber 312*b* begins emptying by pushing formation fluid 320 through the formation fluid output port 307 for sample storage. This action typically continues until a fluid sampling is complete. As noted earlier, the container hydraulic oil 322 is employed for reducing stress across or pressure balancing the first and second seals 315, 316. Adding pressure compensation for the first and second seals 315, 316 serves to decrease or prevent wellbore fluid intrusion across the first and second seals 315, 316. This hydraulic fluid pressure compensation is provided by the wellbore pressure compensator 326 coupled to the hydraulic oil bypass line 328. The third seal 317 is immersed in the formation fluid 320, where seal leakage only slightly reduces a pumping efficiency of the moveable piston 310. The pair of input check valves 325 and the pair of output check valves 327 prevent any wellbore fluid backflow.

The mechanical piston actuator 330 converts rotary motion into linear motion. Here, the rotary portion 330*a* is coupled to the fluid container 305 and the linear portion 330*b* is coupled to the moveable piston 310. Rotating the rotary portion 330*a* in opposite directions moves the linear portion 330*b* and therefore the moveable piston 310 in correspondingly opposite directions causing the formation fluid pump 300 to pump formation fluid. In one example, the rotary portion 330*a* of the mechanical piston actuator 330 is coupled to the fluid container 305 with first and second actuator bearing seals 333*a*, 333*b*. This arrangement typically requires that the rotary portion 330*a* be mechanically connected to a rotary drive shaft that causes penetration of the fluid container 305 and requires the first actuator rotary bearing seal 333*a*. The second actuator bearing seal 333*b* may typically require only a rotary bearing 333*b*. The first and second torsion relief springs 340*a*, 340*b* are positioned at each end of the rotary portion 330*a* of the mechanical piston actuator 330 to assist with a rotational reversal of the mechanical piston actuator 330. The first and second torsion relief springs 340*a*, 340*b* can facilitate a smooth rotational reversal of the mechanical piston actuator 330.

The alternative magnetic coupling device 335 may be employed thereby replacing the rotary bearing seal 333*a*. The magnetic coupling device 335 allows a special form of sealing that provides torque without rotating seal surfaces. With magnetic coupling, the container hydraulic oil 322 and an outside atmosphere may be hermetically separated from each other through static seals. Torque is not transferred through a classic mechanical shaft connection, but rather only through magnetic field coupling from a drive to the mechanical piston actuator 330. The magnetic coupling may be synchronous magnetic coupling (i.e., the magnetic coupling works without slip) as long as a maximum transferable torque is not exceeded. Additionally, this form of magnetic coupling typically requires minimal maintenance and may be employed at elevated temperatures and pressures.

As discussed previously, the gear box 342 employs the gear box output shaft 345 to drive the mechanical piston actuator 330 and thereby the moveable piston 310. The gear box 342 may be employed in the fluid pump 300 to reduce a rotary speed provided by the BLDC electric motor 348. This "step-down" action allows the BLDC electric motor 348 to operate at a higher rotary speed for efficiency purposes, when required. The BLDC electric motor 348 driving the motor output shaft 350 is mechanically coupled through the gear box 342 to the rotary portion 330*a* of the mechanical piston actuator 330. It is controlled to alternately rotate the rotary portion 330*a* of the mechanical piston actuator 330 in opposite directions to linearly move the linear portion 330*b* along with the moveable piston 310 in opposite directions and thereby pump wellbore fluid from the fluid pump 300. As noted, the BLDC electric motor 348, the gear box 342 and the mechanical piston actuator 330 provide a mechanical direct drive capability (as opposed to a hydraulic drive) for the moveable piston 310.

The BLDC motor driver 355 accepts electrical power and up-hole control input and provides motor power and control to the BLDC electric motor 348 through the motor power and control lines 357. Specifically, the BLDC motor driver 355 may provide downhole control of the BLDC electric motor 348 by employing field-oriented control (FOC) of the BLDC electric motor 348, which provides an optimization of motor torque for a motor shaft rotary speed. Additionally, field-oriented motor control reduces torque ripple resulting in smoother motor performance and quieter motor operation.

Field-oriented control is a variable-frequency drive control technology in which motor stator currents of a three-phase electric motor are defined as two orthogonal components that can be visualized with a vector. One component defines the magnetic flux of the motor while the other component defines the torque of the motor. A common objective of field-oriented control is to maximize the motor's torque per ampere of load current. Typically a proportional-integral control approach may be used to keep measured current components at their reference values. Then, pulse-width modulation of the variable-frequency drive defines motor switching signals based on stator voltage references. Additionally, general downhole tool and wellbore pump control signals, and electrical power in some examples, is provided from a surface location, such as the wellbore systems 100 and 150.

Figure 4:
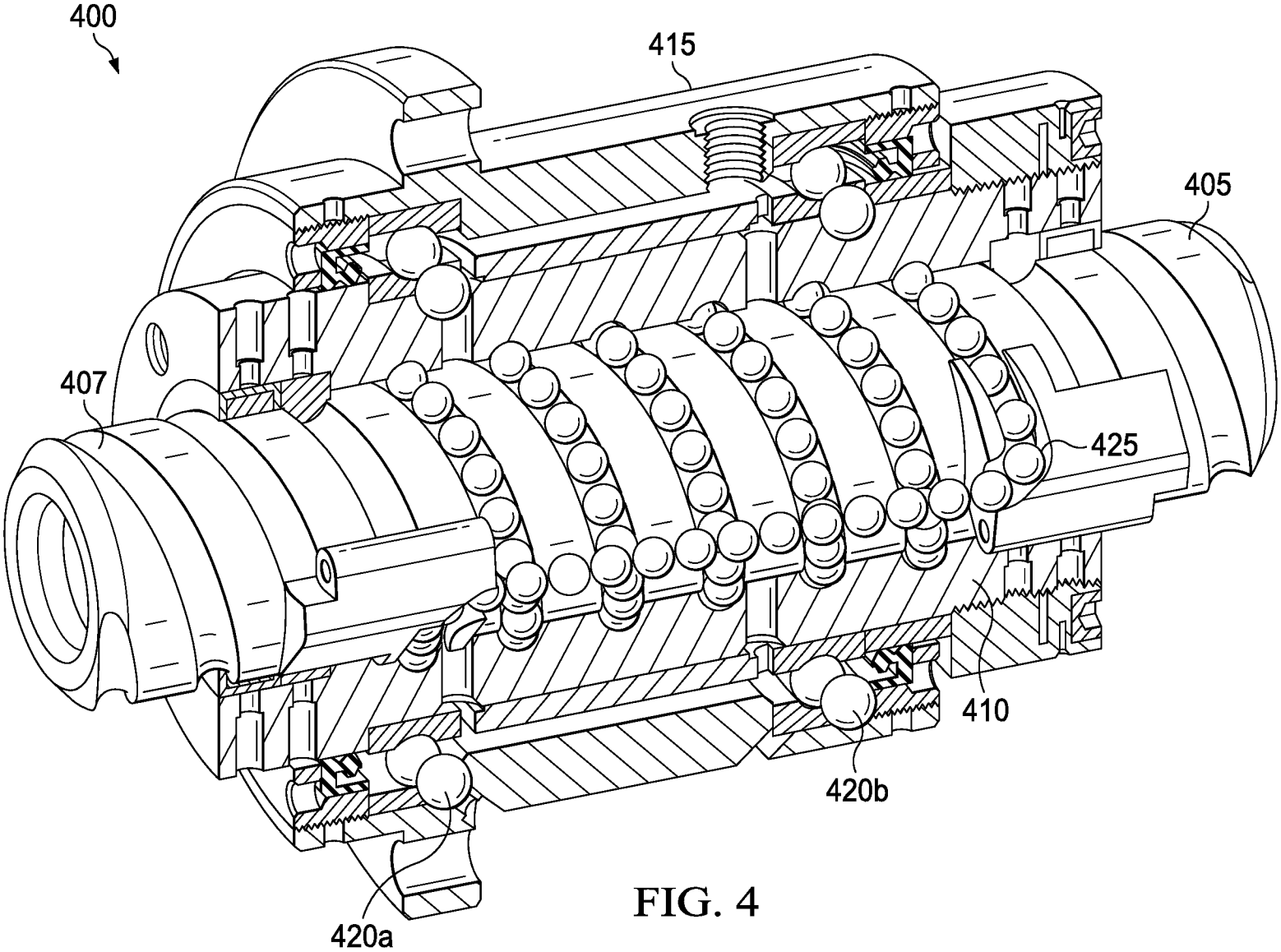
FIG. 4 illustrates an example of a mechanical piston actuator as may be employed in a formation fluid pump such as the formation pump depicted in FIG. 3.

FIG. 4 illustrates an example of a mechanical piston actuator, generally designated 400, as may be employed in a formation fluid pump such as the fluid pump 300 depicted in FIG. 3. In this example, the mechanical piston actuator 400 is a "ballscrew" and includes a rotary portion 405 having a helical raceway 407, a linear portion 410 having a set of ball bearings 425 coupled to the helical raceway 407 and a moveable piston mounting 415, having mounting support bearings 420*a*, 420*b* coupled to the linear portion 410.

The mechanical piston actuator 400 is a mechanical linear actuator that translates rotational motion into linear motion with reduced friction. The helical raceway 407 and the set of ball bearings 425 coupled to the helical raceway 407 act as a precision screw. As well as being able to apply or withstand higher thrust loads, it can do so with reduced internal friction. It may be constructed to close tolerances and is therefore suitable for use in situations in which higher precision may be necessary. The set of ball bearings 425 acts as a "nut" for the threaded shaft, thereby giving rise to the term "ballscrew". Ballscrew nuts are required to have a mechanism to re-circulate the balls, as seen on the set of ball bearings 425.

Other forms of these rotary-to-linear actuators are based on employing rotating rods instead of ball bearings, which may provide higher thrust loads with reduced operating friction, if required. Another form of rotary-to-linear actuator based on a rotating rod is the "rolling ring drive". In this design, a smooth (thread-less) rotary actuator rod or shaft is employed with at least three rolling-ring bearings arranged symmetrically in a surrounding housing. The rolling-ring bearings are set at an angle to the rotary actuator rod, and this angle determines the direction and rate of linear motion per revolution of the rotary actuator rod. An advantage of this design, over the conventional ballscrew, is the reduction of backlash and loading caused by preload nuts. Of course, other current or future rotary-to-linear actuators may be employed in the wellbore pump of FIG. 3 to activate the moveable piston 310.

Figure 5:
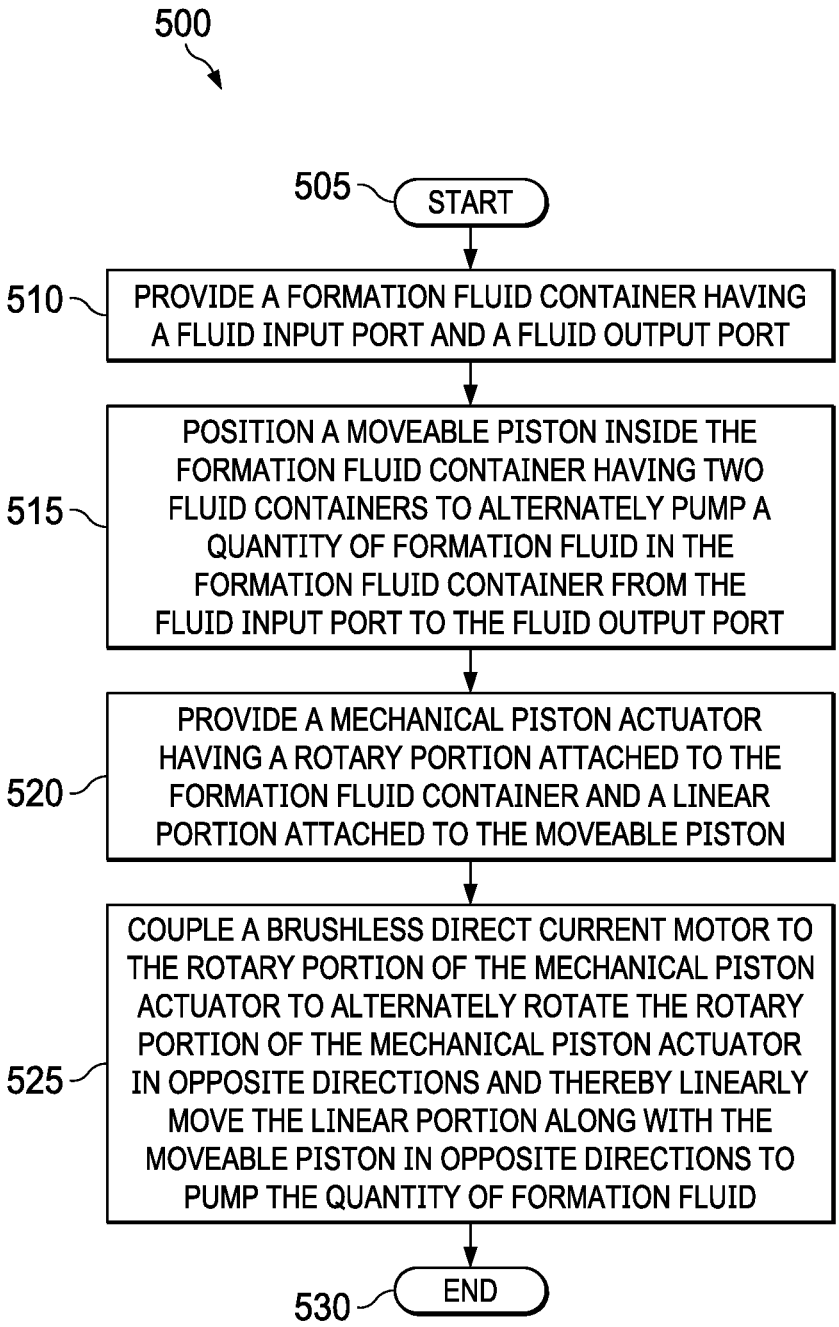
FIG. 5 illustrates an example of a formation fluid pumping method carried out according to the principles of the present disclosure.

FIG. 5 illustrates an example of a formation fluid pumping method, generally designated 500, carried out according to the principles of the present disclosure. The method 500 starts in a step 505 and then, a formation fluid container is provided having a fluid input port and a fluid output port, in a step 510. A moveable piston is positioned inside the formation fluid container having two fluid chambers to alternately pump a quantity of formation fluid in the formation fluid container from the fluid input port to the fluid output port, in a step 515. A mechanical piston actuator is provided having a rotary portion attached to the fluid container and a linear portion attached to the moveable piston, in a step 520. A brushless direct current motor is coupled to the rotary portion of the mechanical piston actuator to alternately rotate the rotary portion of the mechanical piston actuator in opposite directions and thereby linearly move the linear portion along with the moveable piston in opposite directions to pump the quantity of formation fluid, in a step 525.

In one example, a gear box is positioned between the brushless direct current motor and the rotary portion of the mechanical piston actuator. In another example, the moveable piston is pressure compensated inside the wellbore fluid container. In yet another example, the brushless direct current motor is coupled to the rotary portion of the mechanical piston actuator with a magnetic coupling. In a further example, the brushless direct current motor provides an indication of motor axis rotation that relates directly to the quantity of formation fluid pumped.

In a still further example, the brushless direct current motor is controlled to vary a pumping rate of the quantity of formation fluid. In yet a further example, control of the brushless direct current motor is field-oriented thereby controlling a motor torque from the motor shaft of the brushless direct current motor. In a yet further example, a torsion relief spring is positioned at each end of the rotary portion of the mechanical piston actuator to assist with a rotational reversal of the mechanical piston actuator. The torsion relief springs can facilitate a smooth rotational reversal of the mechanical piston actuator. The method 500 ends in a step 530.

While the method disclosed herein has been described and shown with reference to particular steps performed in a particular order, it will be understood that these steps may be combined, subdivided, or reordered to form an equivalent method without departing from the teachings of the present disclosure. Accordingly, unless specifically indicated herein, the order or the grouping of the steps is not a limitation of the present disclosure.

Those skilled in the art to which this application relates will appreciate that other and further additions, deletions, substitutions and modifications may be made to the described embodiments.

Various aspects of the disclosure can be claimed including the apparatuses, systems and methods as disclosed herein. Aspects disclosed herein include:

A. A formation fluid pump, including (1) a formation fluid container having a fluid input port and a fluid output port; (2) a moveable piston inside the formation fluid container having two fluid chambers positioned to alternately pump a quantity of formation fluid in the formation fluid container from the fluid input port to the fluid output port; (3) a mechanical piston actuator having a rotary portion attached to the formation fluid container and a linear portion attached to the moveable piston; and (4) a brushless direct current motor coupled to the rotary portion of the mechanical piston actuator and controlled to alternately rotate the rotary portion of the mechanical piston actuator in opposite directions to linearly move the linear portion along with the moveable piston in opposite directions and pump the quantity of formation fluid.

B. A method of pumping formation fluid, including: (1) providing a formation fluid container having a fluid input port, a fluid output port, and a moveable piston positioned therein having two fluid chambers to alternately pump a quantity of formation fluid in the formation fluid container from the fluid input port to the fluid output port; (2) providing a mechanical piston actuator having a rotary portion attached to the formation fluid container and a linear portion attached to the moveable piston; and (3) coupling a brushless direct current motor to the rotary portion of the mechanical piston actuator to alternately rotate the rotary portion of the mechanical piston actuator in opposite directions and thereby linearly move the linear portion along with the moveable piston in opposite directions to pump the quantity of formation fluid.

C. A wellbore system, including: (1) surface equipment connected through a communications link to a downhole tool; and (2) a formation fluid pump in the downhole tool, having: (a) a formation fluid container having a fluid input port and a fluid output port, (b) a moveable piston inside the formation fluid container having two fluid chambers positioned to alternately pump a quantity of formation fluid in the formation fluid container from the fluid input port to the fluid output port, and (c); a mechanical piston actuator having a rotary portion attached to the formation fluid container and a linear portion attached to the moveable piston; and a brushless direct current motor coupled to the rotary portion of the mechanical piston actuator and controlled to alternately rotate the rotary portion of the mechanical piston actuator in opposite directions to linearly move the linear portion along with the moveable piston in opposite directions and pump the quantity of formation fluid.

Each of aspects A, B and C can have one or more of the following additional elements in combination:

Element 1: further comprising a gear box positioned between the brushless direct current motor and the rotary portion of the mechanical piston actuator. Element 2: wherein the moveable piston is pressure compensated inside the formation fluid container. Element 3: wherein the brushless direct current motor is coupled to the rotary portion of the mechanical piston actuator with a magnetic coupling. Element 4: wherein the brushless direct current motor provides an indication of motor axis rotation that relates directly to the quantity of formation fluid pumped. Element 5: wherein the brushless direct current motor is controlled to vary a pumping rate of the quantity of formation fluid. Element 6: wherein control of the brushless direct current motor is field-oriented thereby controlling a motor torque from the motor shaft of the brushless direct current motor. Element 7: wherein a torsion relief spring is positioned at each end of the rotary portion of the mechanical piston actuator to assist with a rotational reversal of the mechanical piston actuator. Element 8: wherein the mechanical piston actuator is a ball screw. Element 9: further employing a gear box positioned between the brushless direct current motor and the rotary portion of the mechanical piston actuator to alternately rotate the rotary portion. Element 10: wherein the moveable piston is pressure compensated inside the formation fluid container. Element 11: wherein the brushless direct current motor is coupled to the rotary portion of the mechanical piston actuator with a magnetic coupling. Element 12: wherein the brushless direct current motor provides an indication of motor axis rotation that relates directly to the quantity of formation fluid pumped. Element 13: further comprising controlling the brushless direct current motor to vary a pumping rate of the quantity of formation fluid. Element 14: controlling a motor torque from the motor shaft of the brushless direct current motor employing field-oriented control. Element 15: assisting with a rotational reversal of the mechanical piston actuator employing a torsion relief spring positioned at each end of the rotary portion of the mechanical piston actuator. Element 16: wherein the mechanical piston actuator is a roller screw assembly. Element 17: further comprising a gear box positioned between the brushless direct current motor and the rotary portion of the mechanical piston actuator.

What is claimed is:

1. A formation fluid pump, comprising:

a formation fluid container having a fluid input port and a fluid output port;

a moveable piston inside the formation fluid container having two fluid chambers positioned to alternately pump a quantity of formation fluid in the fluid container from the fluid input port to the fluid output port;

a mechanical piston actuator having a rotary portion attached to the formation fluid container and a linear portion attached to the moveable piston; and a brushless direct current motor coupled to the rotary portion of the mechanical piston actuator and controlled to alternately rotate the rotary portion of the mechanical piston actuator in opposite directions to linearly move the linear portion along with the moveable piston in opposite directions and pump the quantity of formation fluid.

2. The pump as recited in claim 1 further comprising a gear box positioned between the brushless direct current motor and the rotary portion of the mechanical piston actuator.

3. The pump as recited in claim 1 wherein the moveable piston is pressure compensated inside the formation fluid container.

4. The pump as recited in claim 1 wherein the brushless direct current motor is coupled to the rotary portion of the mechanical piston actuator with a magnetic coupling.

5. The pump as recited in claim 1, wherein the brushless direct current motor provides an indication of motor axis rotation that relates directly to the quantity of formation fluid pumped.

6. The pump as recited in claim 1, wherein the brushless direct current motor is controlled to vary a pumping rate of the quantity of formation fluid.

7. The pump as recited in claim 1, wherein control of the brushless direct current motor is field-oriented thereby controlling a motor torque from the motor shaft of the brushless direct current motor.

8. The pump as recited in claim 1, wherein a torsion relief spring is positioned at each end of the rotary portion of the mechanical piston actuator to assist with a rotational reversal of the mechanical piston actuator.

9. The pump as recited in claim 1, wherein the mechanical piston actuator is a ball screw.

10. A method of pumping formation fluid, comprising:

providing a formation fluid container having a fluid input port, a fluid output port, and a moveable piston positioned therein having two fluid chambers to alternately pump a quantity of formation fluid in the formation fluid container from the fluid input port to the fluid output port;

providing a mechanical piston actuator having a rotary portion attached to the formation fluid container and a linear portion attached to the moveable piston; and coupling a brushless direct current motor to the rotary portion of the mechanical piston actuator to alternately rotate the rotary portion of the mechanical piston actuator in opposite directions and thereby linearly move the linear portion along with the moveable piston in opposite directions to pump the quantity of formation fluid.

11. The method as recited in claim 10 further employing a gear box positioned between the brushless direct current motor and the rotary portion of the mechanical piston actuator to alternately rotate the rotary portion.

12. The method as recited in claim 10 wherein the moveable piston is pressure compensated inside the formation fluid container.

13. The method as recited in claim 10, wherein the brushless direct current motor is coupled to the rotary portion of the mechanical piston actuator with a magnetic coupling.

14. The method as recited in claim 13 wherein the brushless direct current motor provides an indication of motor axis rotation that relates directly to the quantity of formation fluid pumped.

15. The method as recited in claim 13 further comprising controlling the brushless direct current motor to vary a pumping rate of the quantity of formation fluid.

16. The method as recited in claim 10, further comprising controlling a motor torque from the motor shaft of the brushless direct current motor employing field-oriented control.

17. The method as recited in claim 10, further comprising assisting with a rotational reversal of the mechanical piston actuator employing a torsion relief spring positioned at each end of the rotary portion of the mechanical piston actuator.

18. The method as recited in claim 10, wherein the mechanical piston actuator is a roller screw assembly.

19. A wellbore system, comprising:

surface equipment connected through a communications link to a downhole tool; and a formation fluid pump in the downhole tool, including:

a formation fluid container having a fluid input port and a fluid output port, a moveable piston inside the formation fluid container having two fluid chambers positioned to alternately pump a quantity of formation fluid in the formation fluid container from the fluid input port to the fluid output port;

a mechanical piston actuator having a rotary portion attached to the formation fluid container and a linear portion attached to the moveable piston; and a brushless direct current motor coupled to the rotary portion of the mechanical piston actuator and controlled to alternately rotate the rotary portion of the mechanical piston actuator in opposite directions to linearly move the linear portion along with the moveable piston in opposite directions and pump the quantity of formation fluid.

20. The system as recited in claim 19 further comprising a gear box positioned between the brushless direct current motor and the rotary portion of the mechanical piston actuator.

* * * * *